United States Patent [19]

Whitten

[11] 4,098,154

[45] Jul. 4, 1978

[54] SAFETY END OF RUN FEEDER

[75] Inventor: David L. Whitten, Grand Rapids, Ohio

[73] Assignee: Owens-Illinois, Inc., Toledo, Ohio

[21] Appl. No.: 813,644

[22] Filed: Jul. 7, 1977

[51] Int. Cl.[2] ..... B26D 3/14

[52] U.S. Cl. ..... 83/5; 83/435; 83/437; 83/917; 83/425.2; 144/245 E; 83/406

[58] Field of Search ..... 83/406, 425.2, 435, 83/435.1, 435.2, 437, 917, 5; 144/245 E, 242

[56] References Cited

U.S. PATENT DOCUMENTS

| | | | |
|---|---|---|---|
| 1,838,780 | 12/1931 | Miller et al. | 144/245 E |
| 2,581,049 | 1/1952 | Schempers | 83/5 X |
| 2,855,009 | 10/1958 | McCormick | 83/721 |
| 3,861,256 | 1/1975 | Mullimax | 83/5 |
| 3,901,109 | 8/1975 | Mullimax | 83/5 |

*Primary Examiner*—Donald R. Schran

*Attorney, Agent, or Firm*—D. T. Innis; Myron E. Click; David H. Wilson

[57] ABSTRACT

The apparatus disclosed herein is designed to advance a row of aligned, on edge, sheets of corrugated, which are destined to become partitions, past a table-mounted notching saw. The apparatus is particularly suited to be used at the end of the run to advance all of the remaining corrugated sheets through the notching saw without manual assistance. A horizontally positioned, reciprocable slide member having pairs of pivotally mounted latches which serve to engage the last sheet and, upon actuation of the slide, draws the sheet and column of sheets in front thereof through the saw. One set of latches, upon reciprocation of the slide, moves the sheets to the saw or notching zone and upon further reciprocation the second set of latches will engage the sheets and draw them completely past the notching zone and free of the saw.

7 Claims, 5 Drawing Figures

SAFETY END OF RUN FEEDER

BACKGROUND OF THE INVENTION

This invention relates to apparatus for advancing material past a cutting station in which the apparatus extends over the material, which in this case is rows of corrugated sheets mounted on edge and movable through a notching saw. The row or column that is formed and is moved through the notching saw area is semi-continuously fed by a reciprocating back gauge such as that shown at 32 in U.S. Pat. No. 2,855,009 issued Oct. 7, 1958 to F. A. McCormick.

DESCRIPTION OF THE PRIOR ART

The above-mentioned McCormick patent discloses an apparatus for feeding bundles of corrugated stock 12 on edge into a position in advance of the pusher bar or back gauge 32. With the stock 12 positioned in this zone and in contact with the guide rail 8, the pusher 32 is advanced so as to move the stock bundle 12 forward which results in the severing of the end of the bundle by the band saw 30 into a preselected length. The operation of the apparatus shown in the McCormick device is repeated until such time as the full length of the bundle of stock 12 has been cut into the lengths determined by the position of the rail 8 and saw blade 30. Any pieces less than a size sufficient to make up the total length of a cut, are discarded and a new bundle of corrugated stock will then be fed and sawed into rows and advanced on the table until such time as the total amount of partition strips required have been cut. The partition strips in the McCormick reference are moved on the table 10 and as they are moved by the pusher 32 farther down the line is shown in the drawing, these partition strips will be notched by notching saws in the form of circular saws which will extend through slots or openings in the surface of the table.

The present apparatus is primarily concerned with the movement of the corrugated strips after they have been severed into partition size lengths through the notching saw area.

An apparatus similar to that forming the invention herein is shown in U.S. Pat. No. 3,861,256 issued Jan. 21, 1975 to H. L. Mullinax, and common assignee with the present invention. In the Mullinax reference, there is shown an apparatus which takes the form of a pair of chain driven hooks which may be operated to engage the back of a row of partition strips and draw the strips through the notching zone. This apparatus requires a substantial framework to support the cumbersome mechanism which will overlie the total area of the notching saw and infeed thereto. In the normal operation of the apparatus, the hooks 60 will be stored out of the way to avoid interfering with the normal run of the apparatus and are only installed at the time that the final run or end of run of the partition strips is to take place. When automatic feeding of the continuous column of strips or inserts is being carried out, previous manual methods were considered very hazardous where the last portion of the column was pushed past the slotter saw using a pole or rod.

The present invention is considered to be an improvement over that shown and described in the above-referred-to Mullinax patent.

SUMMARY OF THE INVENTION

Apparatus for moving groups of corrugated partition strips through a notching saw area and for retaining the strips in normally juxtaposed columnar form as the strips are semicontinuously fed through the notching saw or saws. A hydraulically operated latch-carrying, reciprocable member overlies the total notching saw area and upon actuation, will serve to move the fully supply of partition strips into the notching saw area and through the notching saw area by two successive movements of the hydraulic drive apparatus.

BRIEF DESCRIPTION OF THE DRAWINGS

FIG. 3 is a perspective view illustrating the step where the first partition full-through is commencing;

DETAILED DESCRIPTION OF THE DRAWINGS

Figure 1:
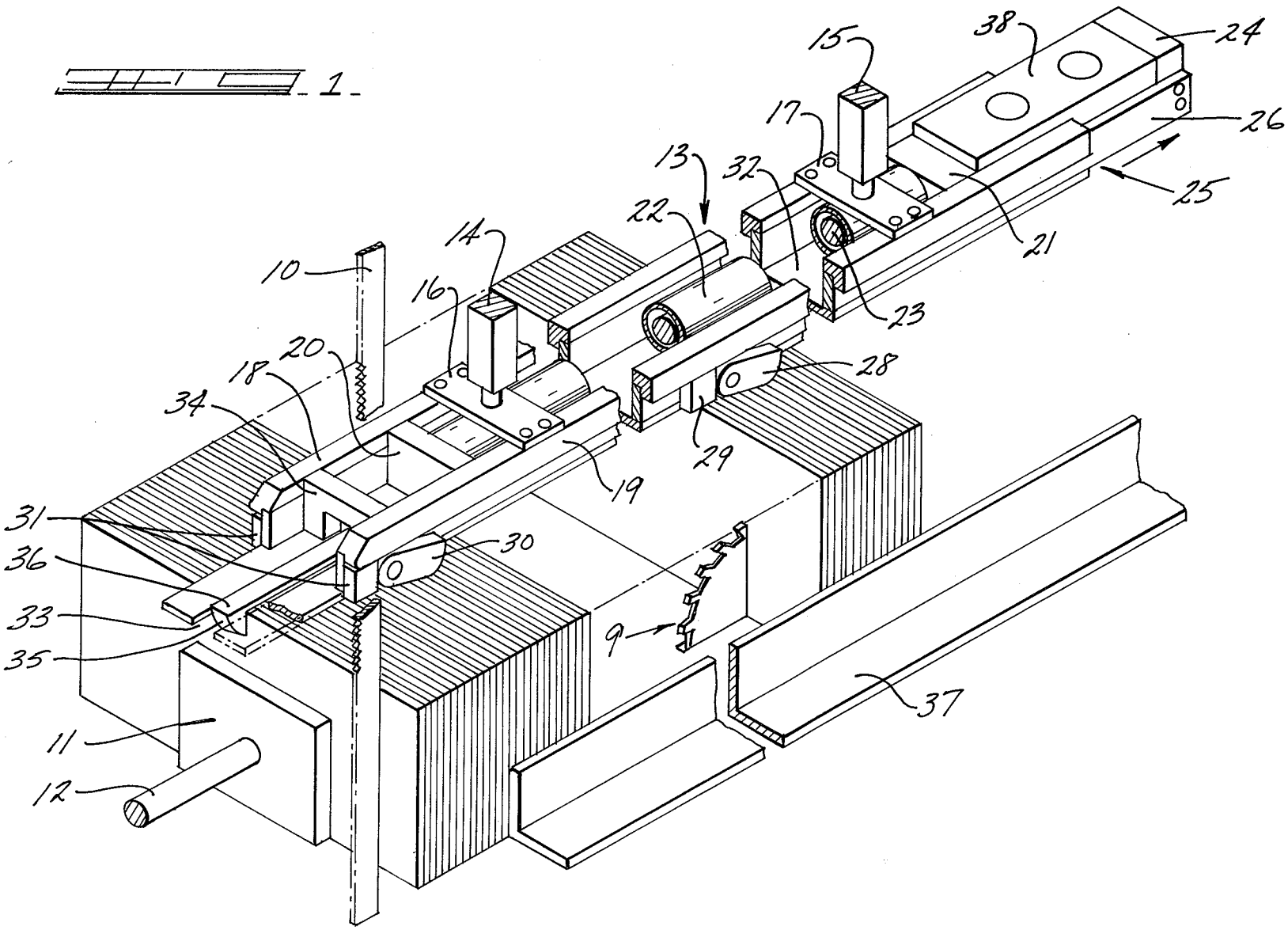
FIG. 1 is a perspective view of the apparatus of the invention in its retracted, safety position.

With particular reference to FIGS. 1–5, wherein the set of drawings illustrates the sequence of operation of the present invention, the following detailed description of the apparatus will be given.

As indicated in the background of the invention, partition strips are cut into desired lengths by the operation of a band saw 10. The stock partition material is moved past the band saw 10 by a pusher 11 whose operating rod 12 is reciprocably driven by a means, not shown. An overhead mechanism for retaining each group of several partition strips in substantially vertical attitude and for supporting the latch-operating mechanism is generally shown at 13. This mechanism is mounted to an overhead support (not shown) by a pair of mounting bars 14 and 15 which are mounted to a pair of horizontal plates 16 and 17. The horizontal plates 16 and 17 in turn are mounted to a pair of side rails 18 and 19 which extend the full length of the apparatus. It should be understood that the mechanism 13 will be of sufficient length so as to extend from the receiving end of the notching area where the pusher 11 moves the bundles of strips, to a position where the operation of the mechanism will move groups or bundles of strips completely out of the saw area. The apparatus in the drawings is shown broken at two places for the purpose of illustration only and, in fact, is one continuous member.

Between the rails 18 and 19 there are located a pair of vertically extending blocks 20 and 21 which serve as the cylinder heads for a hydraulic cylinder 22. The cylinder 22 is also shown broken in two places for convenience in illustration and shows a piston rod 23 extending concentrically therethrough. The piston for the rod 23 is adjacent the block 20 when the piston is in retracted position. The piston rod 23 extends through the block 21 and carries a cross arm or block 24 on this extending end. The cross arm or block 24 is mounted between and forms the rearward end of a slide generally designated 25.

Figure 5:
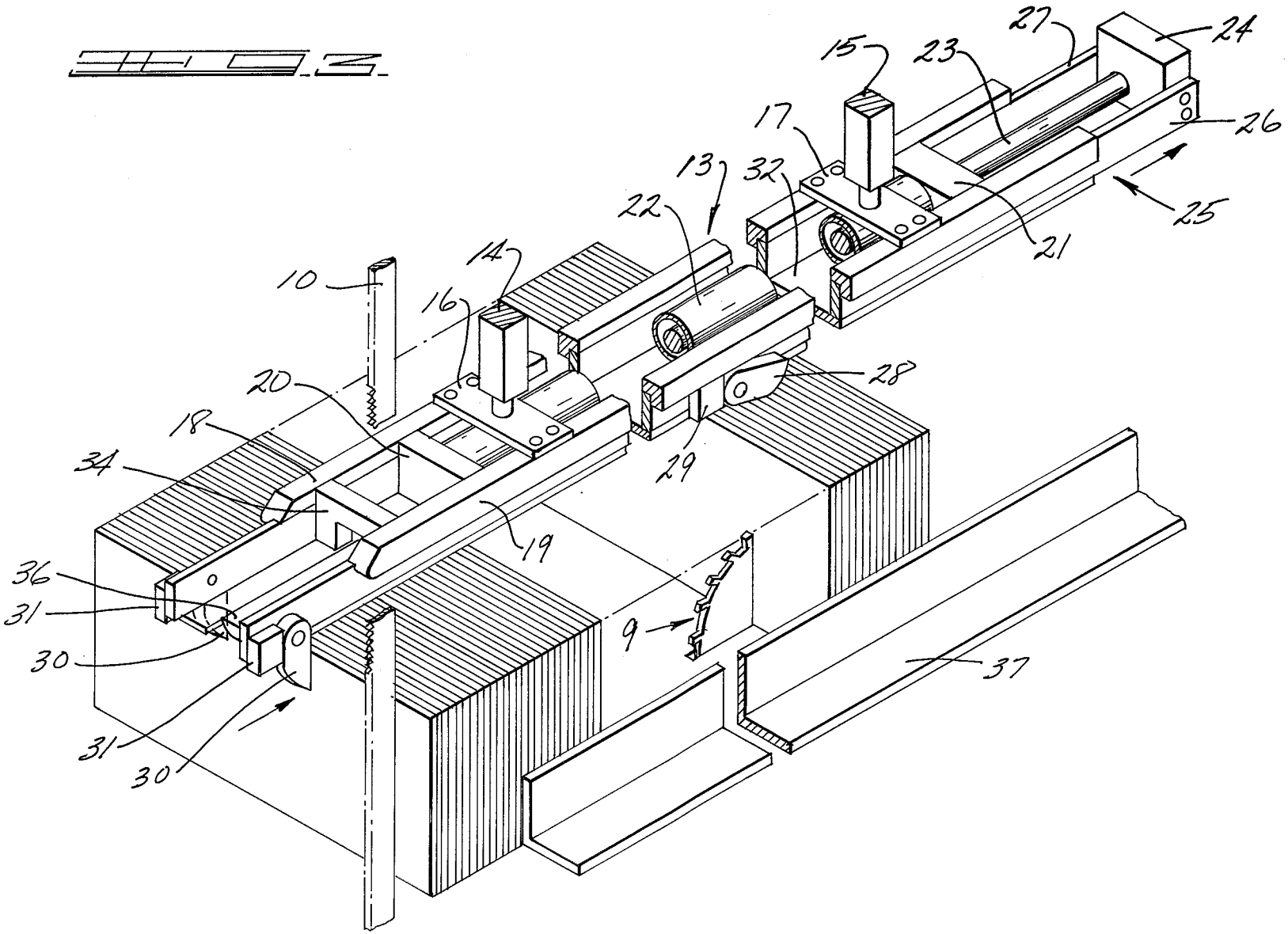
FIG. 5 is a perspective view which illustrates the position of the arm and slide, with the second set of latches in position to complete the pull-through of the partition strips through the saw area.

As best seen in FIG. 3, the slide 25 is composed of a pair of generally horizontally extending side members 26 and 27. Intermediate the length of the members 26 and 27 are pivotally mounted a pair of latches 28, only one of which is visible in the drawing, it being understood that another latch is mounted on the member 27. Each latch is mounted to the slide such that under the influence of gravity, they will pivot clockwise to the position shown in FIG. 5. Further pivotal movement in a clockwise direction, as shown in FIG. 5, is prevented by a stop block 29 mounted to the member 26.

At the forward end of the members 26 and 27 a second pair of latches 30 are similarly pivotally mounted, again with these latches prevented from clockwise movement beyond the vertical by the interpositioning of a pair of stop blocks 31.

The stationary portion of the supporting mechanism 13 is also composed of a generally horizontally extending bottom plate 32 which may be mounted to the blocks 20 and 21. A vertically inverted U-shaped mounting brace 34 which extends between the side rails 18 and 19 serves to support the forward end of the plate 32. At the forward end of the mechanism 13 the plate 32 is formed with an elongated cut-out or slot portion 33. In the cut-out portion 33 of the plate 32, there is positioned a downwardly extending catch 35. The catch 35 is mounted at the forward end of a flat leaf spring 36 and extends below the level of the spring.

With particular reference to FIG. 1, it can be seen that upon movement of the corrugated strips through the band saw 10 by the pusher 11 with the supporting mechanism 13 mounted at approximately the height of the width of the partition strips, since the plate 32 is spaced slightly above the partition strips it serves to hold down the strips as they are moved through the saw area. Those partitions which are moved through the band saw 10 will engage and raise the catch 35 which, after a batch of partitions have moved therebeneath, will prevent the batch from falling backward by the engagement of the last strip by vertical surface of the catch 35, it being understood that the spring 36 will give sufficiently to permit the group or batch of strips to move past the catch 35. It should also be understood that the partition strips are supported on a table whose upper surface generally coincides with the lower surface of an angle bracket 37, mounted thereon and serving to retain the partition strips in a proper, oriented, columnar mode.

With the foregoing apparatus in the position shown in FIG. 1, with a safety block 38 in position between the block 24 and cylinder block or head 21, the apparatus cannot inadvertently be operated and the normal production of partition strips will move beneath the mechanism 13.

When the end of the run of a particular size of partition strips is at hand, the pusher 11 will eventually be without an additional group or bundle of strips to move to the right in FIG. 1. At this point in time the feeding of strips through the saw area 9 will not occur and thus some other means must be used to complete the flow or movement of the strips through the saw area.

With reference to FIGS. 2–5, in sequence, the operation of the present invention will be explained.

Figure 2:
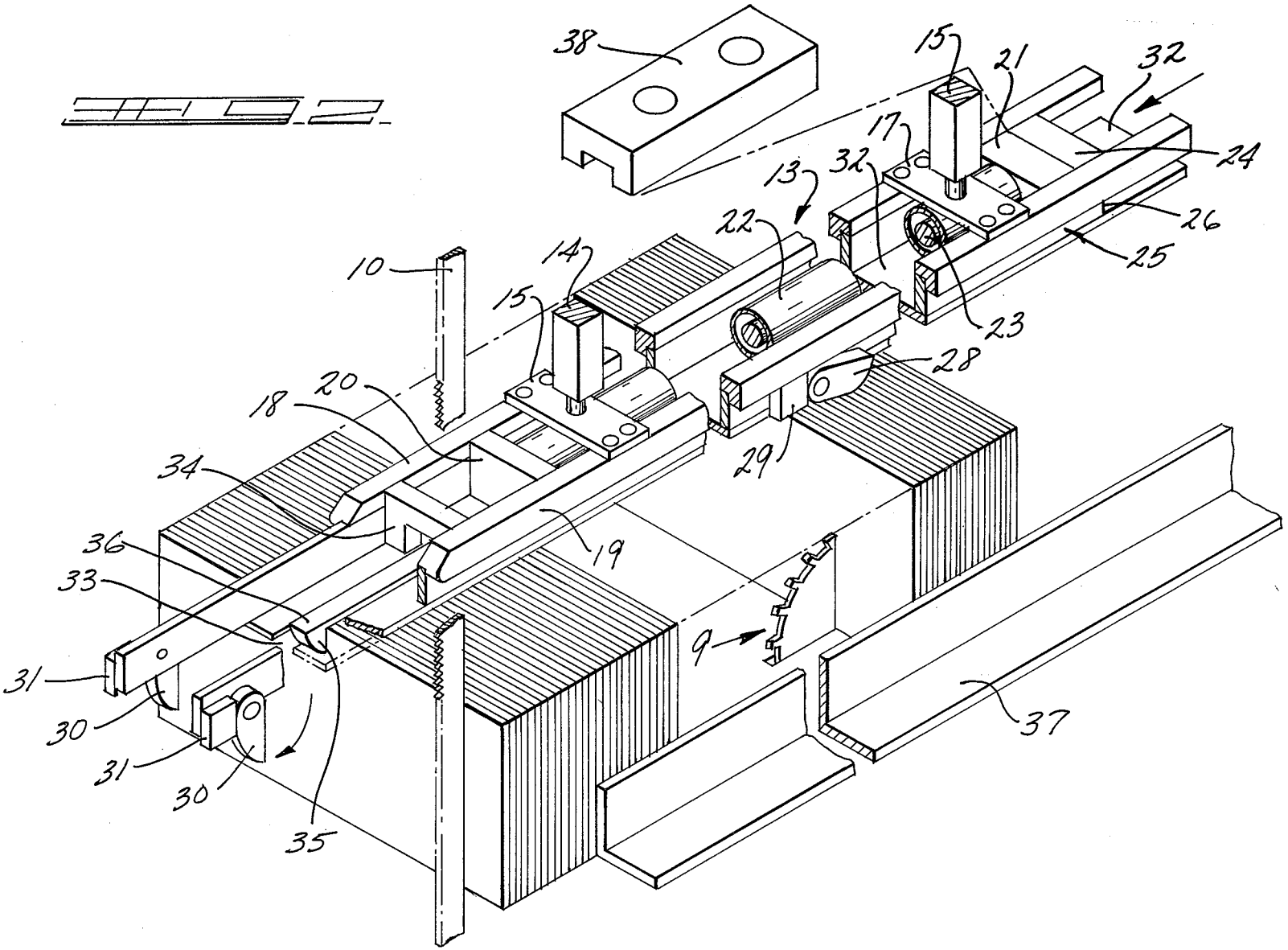
FIG. 2 is a perspective view similar to FIG. 1 showing the slide in position just prior to partition removal from the saw area.

When the apparatus of the invention is to be used, the piston motor or cylinder 22 is actuated to move the slide 25 to the right, in FIG. 1, an amount sufficient to permit the removal of a safety block 38. With the removal of the safety block 38, as shown in FIG. 2, the cylinder 22 is actuated to move the slide 25 to the left, at which time the latches 30 will swing downward, as indicated by the arrow shown therewith.

Figure 4:
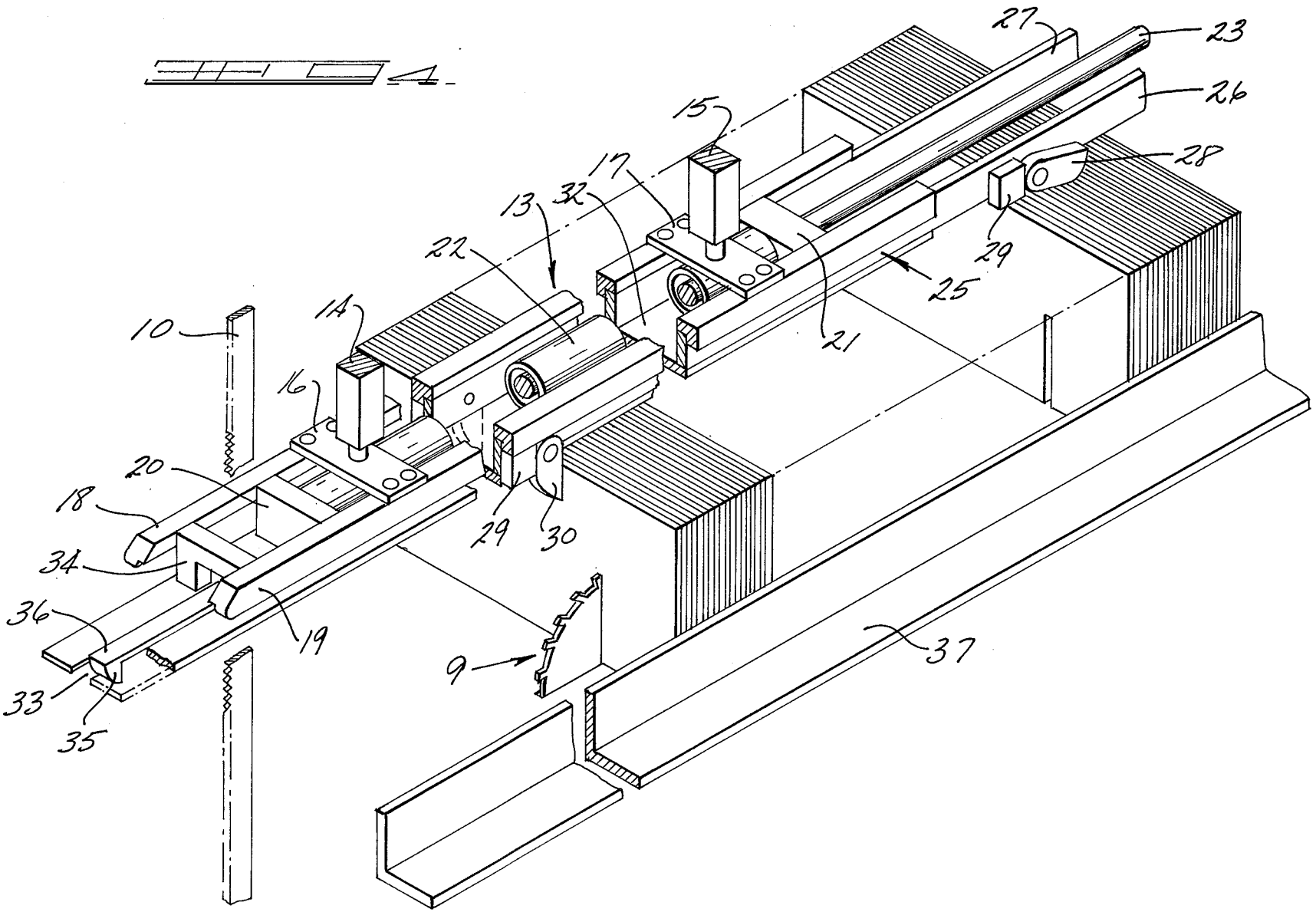
FIG. 4 is a perspective view which illustrates the position of the slide when the first pull-through of partition strips has been completed.
Figure 5:
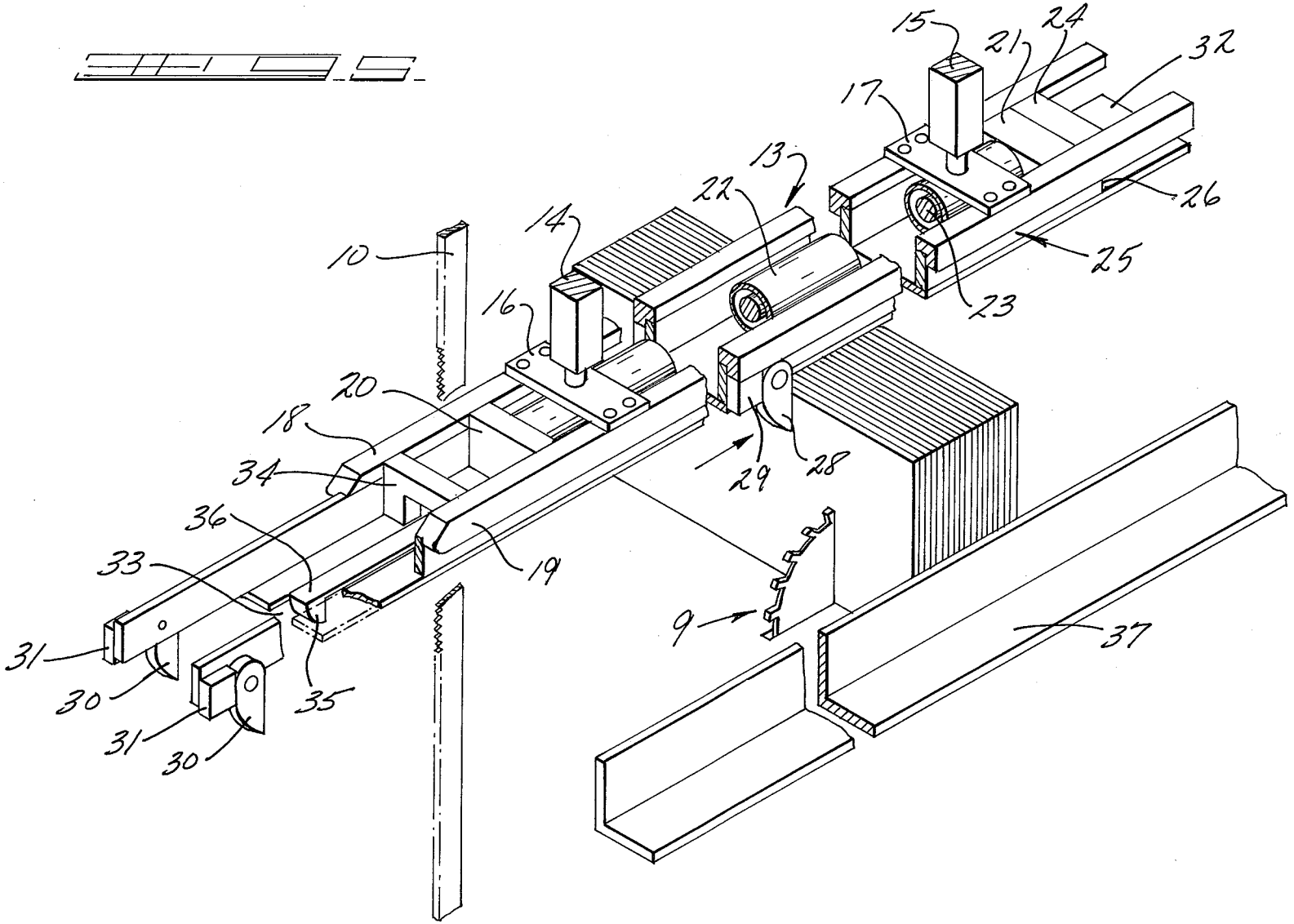

Turning now to FIG. 3, the motor 22 is actuated to move the piston rod 23 to the right, at which time the latches 30 will engage the last partition strip and begin to draw the partition strips through the saw area 9 until such time as they assume the position shown in FIG. 4. At this time, the saw in the saw area 9 will have completed notching the last of the partition strips and at this time it is intended that the circular saw be stopped and the motor 22 is again reversed and, in effect, moved to the position shown in FIG. 5 wherein the latches 28 will pivot downwardly and engage the back of the last partition strip. It should be understood that the bottom plate 32, in effect, holds down the partition strips and prevents them from moving up any appreciable distance. When the apparatus of the invention has assumed the position shown in FIG. 5, the motor 22 may be reversed, at which time the latches 28 can draw to the right and move the already notched partition strips through, and out of the saw area 9 to the exit end to the right of the partition strip forming system. As a matter of actual fact, after the partition strips are notched, they are moved through a zone where air under relatively high velocity is blown through the strips to effectuate removal of carton dust that may have been formed by the notching saw. While the safety blocks has been shown as a means to prevent accidental operation of the apparatus of the invention prematurely, it should be understood that another method of preventing such operation may take the form of a pin or key extending through aligned holes formed in the stationary portion of the mechanism 13 and the slide 25. Removal of the pin would then be the prelude to operation of the mechanism at the end of a run of partition strip forming and notching.

I claim:

1. Apparatus for moving groups of corrugated partition strips that are cut to length sideways through a notching saw area, comprising:

a generally horizontal arm extending in overlying relationship to said groups of partition strips;

a downwardly extending, spring-mounted, catch mounted adjacent the forward end of said arm for serving as a means to retain any group of strips that have passed under the end of the arm in generally compacted order without permitting fall-back;

a horizontally reciprocable slide mounted on said arm;

first pivotal latch means mounted adjacent the forward end of said slide, said first pivotal latch means being pivotally retracted when overlying said groups of strips and downwardly extending when moved by said slide beyond the forward end of said arm.

2. The apparatus of claim 1 wherein said slide is connected to a piston rod of a stationary cylinder carried by said arm.

3. The apparatus of claim 1, further including a second pivotal latch means mounted on said slide in position to engage the column of strips that have been advanced by the first latch means.

4. The apparatus as set forth in claim 1, further including means engageable with said slide to provide a safety stop for the time when the feeder is not to be actuated.

5. The apparatus of claim 1 wherein said arm is closely spaced above the height of the strips to restrain the strips against appreciable vertical movement.

6. The apparatus of claim 2, wherein said cylinder is a pneumatic cylinder with fixed heads mounted to said slide.

7. The apparatus of claim 1, including stop means carried by said slide for preventing pivotal movement of said latches beyond the vertical in one direction.

* * * * *